US009745185B2

(12) United States Patent
Klopfenstein et al.

(10) Patent No.: US 9,745,185 B2
(45) Date of Patent: Aug. 29, 2017

(54) SYSTEM AND DEVICE FOR PREPARING AND DELIVERING FOOD PRODUCTS FROM A MIXTURE MADE UP OF A FOOD LIQUID AND A DILUENT

(71) Applicant: NESTEC S.A., Vevey (CH)

(72) Inventors: Andre Klopfenstein, La Neuveville (CH); Elmar Mock, Colombier (CH); Christoph Rusch, Biel (CH); Naomi Bitmead, Niederwangen (CH)

(73) Assignee: SMIXIN SA, Bienne (CH)

( * ) Notice: Subject to any disclaimer, the term of this patent is extended or adjusted under 35 U.S.C. 154(b) by 47 days.

(21) Appl. No.: 14/716,297

(22) Filed: May 19, 2015

(65) Prior Publication Data

US 2015/0251890 A1 Sep. 10, 2015

Related U.S. Application Data

(62) Division of application No. 13/963,279, filed on Aug. 9, 2013, now Pat. No. 9,056,293, which is a division
(Continued)

(30) Foreign Application Priority Data

Jul. 9, 2004 (EP) ..... 04016210

(51) Int. Cl.
*B67D 1/00* (2006.01)
*B01F 15/04* (2006.01)
*B67D 1/08* (2006.01)

(52) U.S. Cl.
CPC ..... *B67D 1/0016* (2013.01); *B01F 15/0416* (2013.01); *B67D 1/0021* (2013.01);
(Continued)

(58) Field of Classification Search
CPC . B01F 15/0416; B67D 1/0021; B67D 1/0031; B67D 1/0044; B67D 1/0046;
(Continued)

(56) References Cited

U.S. PATENT DOCUMENTS 2,993,683 A 7/1961 Mills
3,898,861 A * 8/1975 McMillin ..... B67D 1/0021 137/238
(Continued)

FOREIGN PATENT DOCUMENTS

DE 20215684 2/2004
WO WO96/36557 11/1996
(Continued)

OTHER PUBLICATIONS

Search Report for International Application No. PCT/EP2005/006305 dated Feb. 1, 2006.
(Continued)

*Primary Examiner* — J. Casimer Jacyna
(74) *Attorney, Agent, or Firm* — K&L Gates LLP

(57) ABSTRACT

The invention relates to a system for hygienically reconstituting and delivering food preparations, such as drinks, comprising a metering and mixing device connected to a container containing a base liquid, in the form of a package configured to be connected to a base station. The metering and mixing device comprises a pump for metering the liquid, a diluent intake and a mixing chamber. Coupling means are provided for providing the diluent supply and the means for driving the liquid pump.

11 Claims, 9 Drawing Sheets

Related U.S. Application Data of application No. 11/571,647, filed as application No. PCT/EP2005/006305 on Jun. 13, 2005, now Pat. No. 8,511,516.

(52) U.S. Cl.
CPC ..... *B67D 1/0031* (2013.01); *B67D 1/0046* (2013.01); *B67D 1/0079* (2013.01); *B67D 2001/0811* (2013.01); *Y10T 137/8766* (2015.04); *Y10T 137/87595* (2015.04)

(58) Field of Classification Search
CPC B67D 1/0079; B67D 1/10; B67D 2001/0811; B67D 2001/0812; B67D 2210/00031; B67D 2210/00034
USPC ... 222/129.1, 129.3, 129.4, 133, 134, 145.1, 222/145.2, 145.5–145.7, 190
See application file for complete search history.

(56) References Cited

U.S. PATENT DOCUMENTS

| | | | | |
|---|---|---|---|---|
| 4,306,667 | A | | 12/1981 | Sedam et al. |
| 4,538,636 | A | | 9/1985 | Cleland |
| 4,711,374 | A | | 12/1987 | Gaunt et al. |
| 4,907,725 | A | | 3/1990 | Durham |
| 5,305,923 | A | | 4/1994 | Kirschner et al. |
| 5,494,193 | A | | 2/1996 | Kirschner et al. |
| 5,570,822 | A | * | 11/1996 | LeMarbe ..... B67D 1/0027 222/129.1 |
| 5,615,801 | A | | 4/1997 | Schroeder et al. |
| 5,727,713 | A | | 3/1998 | Kateman et al. |
| 5,842,603 | A | * | 12/1998 | Schroeder ..... B67D 1/0021 222/129.1 |
| 6,460,734 | B1 | | 10/2002 | Schroeder et al. |
| 6,554,165 | B2 | | 4/2003 | Cote |
| 6,568,565 | B1 | | 5/2003 | Schroeder et al. |
| 6,871,761 | B2 | | 3/2005 | Fox |
| 7,036,688 | B2 | | 5/2006 | Stettes et al. |
| 2002/0175181 | A1 | | 11/2002 | Schroeder et al. |
| 2003/0000964 | A1 | | 1/2003 | Schroeder et al. |
| 2003/0150879 | A1 | | 8/2003 | Ufheil et al. |
| 2004/0129720 | A1 | | 7/2004 | Cheng et al. |

FOREIGN PATENT DOCUMENTS

| | | |
|---|---|---|
| WO | WO 01/21292 | 3/2001 |
| WO | WO 03/013712 | 2/2003 |

OTHER PUBLICATIONS

Written Opinion for International Application No. PCT/EP2005/006305.

* cited by examiner

SYSTEM AND DEVICE FOR PREPARING AND DELIVERING FOOD PRODUCTS FROM A MIXTURE MADE UP OF A FOOD LIQUID AND A DILUENT

CROSS REFERENCE TO RELATED APPLICATIONS

The present application is a divisional of U.S. Ser. No. 13/963,279, filed Aug. 9, 2013, which is a divisional application of U.S. Ser. No. 11/571,647, filed Jan. 4, 2007, issued as U.S. Pat. No. 8,511,516, which is a National Stage of International Application No. PCT/EP2005/006305, filed on Jun. 13, 2005, which claims priority to European Patent Application No. 04016210.9, filed Jul. 9, 2004, the entire contents of which are being incorporated herein by reference.

BACKGROUND

The present invention relates to a system for preparing and delivering a mixture of a base liquid and a diluent. More particularly, the invention relates to the preparation and delivery of drinks, or other liquid food products, by metering a food liquid and mixing this food liquid with a diluent. The invention finds an application in the delivery of drinks, with or without froth, hot or cold, from a liquid concentrate and water, hygienically, easily and quickly, even when the volumes delivered are large.

SUMMARY

In conventional drinks dispensers, the drinks are reconstituted from a liquid concentrate or powder contained in reservoirs. The liquid concentrate or the powder is metered then mixed with a diluent, generally hot or cold water, inside the dispenser, passing through pipes, pumps and mixing bowls. Mixing is generally performed by a mechanical stirrer contained within a chamber. The conventional preparation of these drinks therefore requires a great deal of maintenance and cleaning in order to keep those parts that are in contact with the food product constantly clean and avoid the risks of contamination and bacterial growth. The machines also represent a significant investment on the part of the operators. Finally, these machines lack versatility in terms of the choice of drinks delivered, even though the current trend is to extend the choice of hot, cold, frothy or non-frothy drinks.

Systems do exist for delivering fruit juices from a disposable or recyclable package containing concentrate and incorporating a pump operated by a dispensing device external to the package. Such a system is described, for example, in U.S. Pat. No. 5,615,801.

Before that, the pump formed part of the dispensing machine itself, but in order to alleviate the disadvantages associated with maintaining and cleaning the pump and the elements associated with it, the solution in U.S. Pat. No. 5,615,801 is to incorporate the food liquid pump into the package and control the activation of this pump by the machine by connecting the package to the machine and, more particularly, by connecting the pump to the machine. The operator needs merely to replace the package and replace it with a new package or different package in order to proceed with dispensing another drink. Any cleaning is then no longer required. U.S. Pat. No. 5,615,801 provides an improvement to this type of package by providing a Moineau pump which produces a continuous flow of concentrate which spreads out in the form of a fine film through a valve and allows mixing with the diluent, in that instance water, in a mixing chamber belonging to the package.

Such a solution does, however, present several disadvantages. The mixing in such a system is not optimised because of the way in which the diluent and the concentrate meet, in the mixing chamber. In addition, there are risks that the diluent might rise back up through the concentrate duct. If it did, problems of hygiene may arise. In addition, the concentrate metering is restricted by the design of the system and the viscosity of the concentrate. Specifically, the device is not suited to certain thick concentrates for which it is unable to produce a fine film through the valve and thus perform the mixing. In addition, for correct metering, the concentrate flow rate is reduced because of the nature of the pump which has by itself to overcome the significant pressure drop created by the valve. It is therefore impossible, within a reasonable space of time of the order of 10 to 40 seconds, to produce large-volume drinks from certain types of concentrate such as concentrates based on coffee or on cocoa. A device such as this is also not designed to produce froth when preparing the drink. Now there is a need to produce frothy drinks such as a black coffee, a cafe latte or a flavoured coffee, or a hot chocolate, which are obtained from liquid concentrates and water. Another disadvantage stems from the complexity of such a system and the large amount of space it occupies because of the great number of parts. Such a system is therefore expensive.

Similar devices are described in U.S. Pat. No. 5,305,923 and U.S. Pat. No. 5,842,603, which have the same disadvantages as the patent already discussed.

U.S. Pat. No. 6,568,565 relates to a method and a device for delivering a drink from a concentrate contained in a disposable multi-portion container. The container comprises an adapter onto which a metering pump, itself disposable, is force-fitted. A mixing chamber is provided, in which a diluent mixes with the metered concentrate. The drink is delivered through a non-disposable delivery nozzle. The system is complicated, bulky and expensive because the pump, the mixing chamber and the nozzle constitute numerous separate parts which are connected by numerous couplings. Activation of the pump is via a system which is just as complicated, using a pump operating system equipped with a drive fork.

Patent application WO 01/21292 relates to a method and device for production of a beverage wherein concentrate is brought to a joining zone in a mixing chamber; in which joining zone the concentrate is brought together with a diluent. Gas is supplied to a gas zone in the mixing chamber through which the mixture of concentrate and diluent is brought to flow and which is located downstream relative to the joining zone. First of all, this solution is not a compact solution for preparing a liquid food from a concentrate since the device is associated to a peristaltic pump for metering the concentrate which is separate from the device itself. Secondly, dosing from a peristaltic pump is not accurate enough for food liquid concentrates of relatively high solid concentration. Dosing is also not even from dose to dose due to the non-continuous peristaltic arrangement that delivers product pulses. Thirdly, the device is not a packaging and it cannot be disposed after use. The device must be thus cleaned for being able to be re-used without hygienic risks. Fourthly, there is not a pressure reduction which is sufficient to prevent the risk of the diluent rising back up in the concentrate line and therefore, a valve is needed in the concentrate line to prevent that risk. Despite this valve risk remains high that diluent can enter the concentrate line. Finally, the way air is drawn in the chamber is not optimal due to the lack of pressure difference, the size and the relative position of the conduits.

There is therefore a need for a system that is simpler, hygienic, compact and economical and provides solutions to all the aforesaid problems.

In a first aspect, the invention relates to a device for metering a base liquid and mixing this base liquid with a diluent to prepare a food product, the device being able to be connected to a container containing the liquid, and the device comprising:

a liquid pump configured to meter a quantity of liquid through a liquid metering duct, a diluent inlet with a diluent duct, a mixing chamber for mixing the liquid with the diluent, wherein:

the diluent duct is positioned relatively to the liquid metering duct so that the diluent stream intersects the liquid stream before or at the mixing chamber and wherein it comprises a means for accelerating the speed of the diluent stream where the said diluent and liquid streams meet with respect to the speed of the diluent at the diluent inlet.

Thus, the device according to the invention provides an improved solution for metering then correctly mixing a liquid with a diluent. Through the inherent speed of the diluent and the meeting of the ducts the shearing of the fluids and the mixing of the fluids in the mixing chamber are improved. More precisely, the liquid which arrives at a very low speed is carried along with the diluent, arriving at a higher speed, at the point of intersection; this encourages the entrainment of the liquid, thus forced into movement, and thus the creation of turbulence in the mixing chamber to form the mixture. The resultant accelerating of the diluent makes it possible to create a pressure at the point where the streams meet which is lower than or equal to the pressure in the liquid duct at the pump outlet.

The advantages are two-fold:

the shear forces are increased to encourage mixing in the mixing chamber, and the diluent is prevented from being able to rise back up inside the liquid duct, particularly when the pump is switched off, which could give rise to hygiene problems.

According to a preferred embodiment of the invention, the means for accelerating the speed of the diluent comprises a venturi means in the form of at least one restriction situated at the diluent duct before or where the streams meet. Thus, the restriction makes it possible to accelerate the flow of diluent when it meets the liquid, and therefore makes it possible advantageously to lower the pressure. Such a principle is simple to implement because it does not involve any moving parts. The diluent meets the metering liquid at a relatively high speed, producing shear effects and also preventing the diluent from rising back up inside the liquid metering duct. The speed of the fluid then drops in the mixing chamber which, of larger cross section, encourages the creation of a homogeneous liquid-diluent mixture inside the chamber.

The diluent duct is preferably directed toward the outlet of the liquid metering duct or slightly below it to ensure that the diluent and liquid streams collide relatively one another. In a possible mode the diluent and liquid metering ducts are directly positioned in intersection. In alternative modes, the two ducts are positioned to terminate each one separately in an enlarged mixing chamber but still in intersection of their streams.

As a preference, the diluent duct comprises at least one terminal portion which, with the restriction and the inlet to the mixing chamber, forms an alignment. The liquid duct at the pump outlet for the passage of the liquid is transversal to the said alignment. This configuration affords a particularly effective venturi effect in which the diluent is displaced more or less linearly to create a sufficiently great pressure reduction. The pressure reduction is also capable of drawing the liquid through the duct at the pump outlet when the pump is switched off without the diluent rising back up inside the said liquid duct. The term "alignment" is to be understood as meaning that there are no elbows or sharp bends likely to break or significantly slow the flow of diluent through the restriction.

According to one possible aspect, the device is configured in such a way as to be able to produce a frothy preparation. The device comprises an air intake communicating with at least one of the ducts before the mixing chamber, or in the mixing chamber itself, to carry air into the mixture and cause the preparation to froth. As a preference, the air intake is positioned in communication with the restriction in order to benefit from the suction created and carry in air and froth at least some of the diluted liquid, for example a drink, in the mixing chamber. The air intake is thus sized in such a way as to carry the required quantity of air into the mixing chamber. The air may also be used at the end of the delivery operation to clean the chamber and expel therefrom at the very end of the delivery cycle any amount of drink and/or froth that may still remain in the chamber.

In one mode, the air intake is positioned relatively to the diluent duct and the liquid metering duct for the air to be sucked in the diluent stream before the diluent stream intersects or collides with the liquid stream. For instance, the air intake can be placed in intersection of the diluent duct before the point of collision between the diluent stream and the liquid stream. In this arrangement, air bubbles are sucked in the diluent stream before the diluent mixes with the liquid. The point of collision between the aerated diluent and liquid may be placed in the mixing chamber or before the mixing chamber, i.e., at the intersection of diluent and liquid ducts. This arrangement solves a problem of contamination of the air intake. Indeed, one has noticed that product can enter the air channel when the air channel is positioned after the intersection in the mixing chamber. According to the laws of physics, due to velocity and the pressure difference created, the diluent does not enter the air channel and therefore the air channel cannot be cleaned by a flush cycle of the diluent. As a result, this can cause a problem of bacteria growth. By having the air intake at the diluent level only, one ensures that product such as diluted concentrate does not contaminate the air conduit.

The pump may be any pump capable of transporting a liquid in a wide range of viscosities, particularly between 1 and 5000 centipoise. It may be a gear pump, a peristaltic pump or, alternatively, a piston pump.

The metering and mixing device according to the invention is intended to be controlled by means of a dispensing base device with which the metering and mixing device is docked in a complementary manner. The second device with which the first docks is known as a "base station" in the remainder of the description, for greater conciseness and clarity. Thus, coupling means are provided and configured in such a way as to connect the metering and mixing device to the base station, which is itself capable of providing the diluent supply and the means for driving the liquid pump. Dissociating the metering and mixing devices from the function of driving the pump and supplying the diluent affords the essential advantage that the metering and mixing device can be interchanged as often as necessary, for example may be replaced by a new device which is assembled with a new container. Such replacement makes it possible to dispense with, or at the very least considerably reduce, the need for maintenance and cleaning of the metering and mixing device. That also allows greater flexibility in the choice of the metering and of the mixing, by interchanging the metering and mixing devices while at the same time keeping a common base station.

In a preferred embodiment, however, the pump is a pump of the gear type. Such a pump comprises a chamber in which a series of rotary elements which collaborate in the manner of gearing is housed. The pump comprises an inlet passage for letting the liquid into the pump chamber and a liquid outlet passage connecting the pump chamber to the liquid metering duct, the liquid inlet and outlet passages being more or less in alignment with the gearing formed by the series of rotary elements. A gear pump in the context of the invention provides a more uniform flow of metered liquid, better precision on the amount of liquid metered and a more compact construction involving a relatively limited number of moving parts. The rotary elements are thus preferably two in number, although the number of pairs of elements is not a limitation in itself. For preference, a first rotary element is extended by a coupling means associated with drive means belonging to the base station. As is known per se, the rotary element comprising the coupling means is usually termed the "master" element while the other rotary element is usually termed the "slave" element.

In one possible mode, a non-return valve is positioned in the liquid metering duct to prevent any potential dripping from the pump at the intersection and in the mixing chamber. Indeed, although a gear pump provides a seal function, it is not possible to assure a total liquid tightness with the pump only during the rest period of the device, especially, when low viscosity concentrates are used.

As one of the objects of the invention is to limit any possible interaction between the product and part of the machine, the metering and mixing device comprises its own duct for delivering the flow of food liquid, thus diluted and mixed, directly downstream of the mixing chamber into a receptacle. A receptacle is to be understood as meaning, for example, a glass, a bowl or a mug or any other receptacle to serve to the consumer.

In a preferred configuration, the metering and mixing device of the invention is in the form of a cap which is connected to the container by appropriate connecting means. Thus, more precisely, the mixing device comprises two half-shells assembled along a parting line passing through the suction means and the pump. The construction in the form of a cap with two half-shells offers the advantage of requiring fewer assembly parts and also of being more compact by comparison with the known constructions that usually incorporate pumping and mixing means.

One or other of the half-shells or, alternatively, both half-shells, defined by being assembled in this way, passing through their parting line:

the chamber of the pump and its metering duct, the suction means comprising at least the restriction, the diluent duct, the mixing chamber, optionally, the air duct, and preferably also, the duct for delivering the food preparation, for example the drink.

The metering and mixing device, in this configuration as two half-shells is preferably made of plastic, such as an injected or moulded plastic. The device may thus be used for a limited number of metering operations then disposed of or recycled.

In the even more preferred embodiment, the device is associated with a container which, together with the metering and mixing device, forms a package that may be disposable or recyclable. The container may be a non-collapsible or a collapsible member. It may be, for instance, a bottle, a brick, a pouch, a sachet or the like. It may be made of plastic, cardboard, paper, aluminum or a mixture and/or laminate of these materials. The container and the device may be connected by permanent or detachable means. Permanent means may be designed to be sealing, welding, bonding, non-reversible clipping means, etc means. Detachable means may mean an assembly formed of a threaded portion or equivalent complementary mechanical engagement means on the cap forming the metering device which collaborates with a threaded portion or complementary mechanical engagement means belonging to the container.

The metering and mixing device fits in a simple and quick way against the base station. For that, the coupling means of the device preferably lie on the same side so as to allow the coupling to be made by manually plugging into a docking panel of the base station itself comprising complementary coupling means. Thus, the user can easily perform the docking operation by hand in a simple movement by taking hold of the mixing and metering device, on which the container is preferably mounted, and pushing it against a panel of the base station. More specifically, the coupling means also comprise means for translational guidance, in at least one direction that encourages plugging-in or docking, of the metering device with complementary guide means on the docking panel of the base station. Obviously, other docking methods are possible which combine several directions of plugging-in, such as a translational direction and a rotational direction, or in several directions combined along/about various axes of translation and/or of rotation.

The metering and mixing device according to the invention may also comprise a code that can be read by a reader associated with the base station. The code comprises information referring to the identity and/or the nature of the product and/or to parameters concerned with the activation of the diluent supply and/or liquid pump drive means. The code may, for example, be used to manage the flow rate of the liquid pump and/or of the diluent pump, contained in the base station, so as to control the liquid:diluent ratio. Other uses of the code are possible, such as checking the authenticity of the product contained in the container or alternatively adjusting the means to alter the temperature of the diluent.

According to another aspect, the invention relates to a package for metering a liquid and mixing this liquid with a diluent to prepare a food product, comprising:

a multi-dose container to form a reserve of liquid;

a metering and mixing device comprising:

a diluent inlet, a liquid pump for metering the quantity of liquid, a mixing chamber for mixing the liquid and the diluent, coupling means configured to connect the metering and mixing device to a base station capable of providing the diluent supply and the means for driving the concentrate pump, characterized in that the metering and mixing device forms a cap connected to the container.

In effect, there is not, in the prior art, any package that affords both the advantages of hygiene associated with the use of a metering pump incorporated into the package, and the advantages stemming from a simple and inexpensive structure suited to use over a limited period of time or that can be recycled. Hence, the invention satisfies these combined objectives by causing the metering device, ordinarily complicated and made up of several elements assembled by couplings, thus to adopt the form of a cap associated with the container as a closure.

More specifically, the cap comprises two half-shells assembled with one another along a substantially longitudinal parting line and configured to delimit at least the contours of the chamber of the pump and the mixing chamber. In other words, the two parts are assembled longitudinally along a parting line running in the direction in which the fluids are transported, in particular in the direction in which the liquid and the mixture consisting of the liquid and the diluent are transported. By contrast, the prior art usually consists in providing several ducts and couplings following on from one another in the direction in which the fluids are transported, resulting in greater complexity, rapid soiling and hygiene risks that are greater because of the changes in cross section and the numerous parts employed, and resulting in a cost of manufacture which is also higher.

According to the invention, the liquid metering duct is positioned to intersect the diluent duct before the mixing chamber. The metering and mixing device comprises, to complement the liquid metering pump, a means for increasing the speed at which the diluent arrives at the point where the streams meet. Such a means is preferably a restriction in communication with the diluent intake situated upstream of the mixing chamber so that the flow of diluent is accelerated through the restriction.

The frothing of the preparation, a drink for example, may be obtained when the suction means additionally comprise an air intake allowing air to be carried in to the mixture and to froth the liquid-diluent mixture, for example a drink, in the mixing chamber. An air intake may, however, be omitted or be selectively closed off when the preparation does not need to be frothed. The cross section of the air intake can vary according to the nature of the food liquid contained in the package. Thus, the cross section of the air duct may vary between 0.05 and 2 $mm^2$, preferably 0.1 and 0.5 $mm^2$.

The liquid may be a food concentrate intended to reconstitute a hot or cold, frothy or non-frothy drink. For example, the liquid is a concentrate based on coffee, cocoa, milk, tea, fruit juice or a combination of these components. The concentrate may be a liquid for producing a cafe latte for example, comprising a coffee concentrate and condensed milk or a creamer. The viscosity of the liquid may vary according to the nature of the concentrate.

Typically, this is between 1 and 5000 cPoise, preferably 200 to 1000 cPoise, more preferably still between 300 and 600 cPoise.

The invention finally relates to a base station on which a metering and mixing device or a package as previously defined is intended to be docked.

The base station comprises:

a) a technical area comprising diluent supply means, liquid pump drive means, b) an interface area for the user, comprising coupling means complementing the coupling means belonging to the device, which are configured to receive the metering and mixing device in a predetermined position and which comprise diluent coupling means and means for coupling the pump, control means for controlling the supply of diluent and driving the liquid pump.

Thus, the preferred station comprises two separate areas, including an interface area accessible to the user. Such an area may be protected by protective means such as a cover or the like, but this is not indispensable. By contrast, part of this area may be left visible to allow better interactivity with the user and thus make interchanging the packages easier.

More precisely, the diluent supply means comprise a water supply duct connected to a water pump and to a system for controlling the temperature of the water. The temperature control system may be a heating system such as a thermobloc, a heater cartridge, a boiler or any other equivalent means. The control system may also be a refrigeration system able to produce refrigerated drinks or desserts.

The pump drive means may comprise an electric motor and a drive shaft connected to the complementary coupling means to link with the coupling means of the liquid pump. The coupling means may be formed of a mechanical push-together connection of the male-female type, a magnetized mechanism, a screw-fastening system or bayonet system, or any other equivalent means.

The interface area comprises guide means complementing the guide means of the metering and mixing device in order to allow the device to be docked. The complementary guide means are configured in such a way as to guide the metering device in a translational direction during docking or in one or more other directions. Means for securing the metering device in the docked position may be provided.

The base station comprises a controller associated with the control means and programmed to control and coordinate the activation of the liquid pump drive means and the activation of the diluent supply means. When the metering and mixing device or the packaging comprises a code, the controller is associated with a reader capable of reading this code and processing the information read.

Additional features and advantages are described herein, and will be apparent from the following Detailed Description and the figures.

BRIEF DESCRIPTION OF THE FIGURES

The characteristics and advantages of the invention will be better understood in relation to the figures which follow.

DETAILED DESCRIPTION

Figure 1:
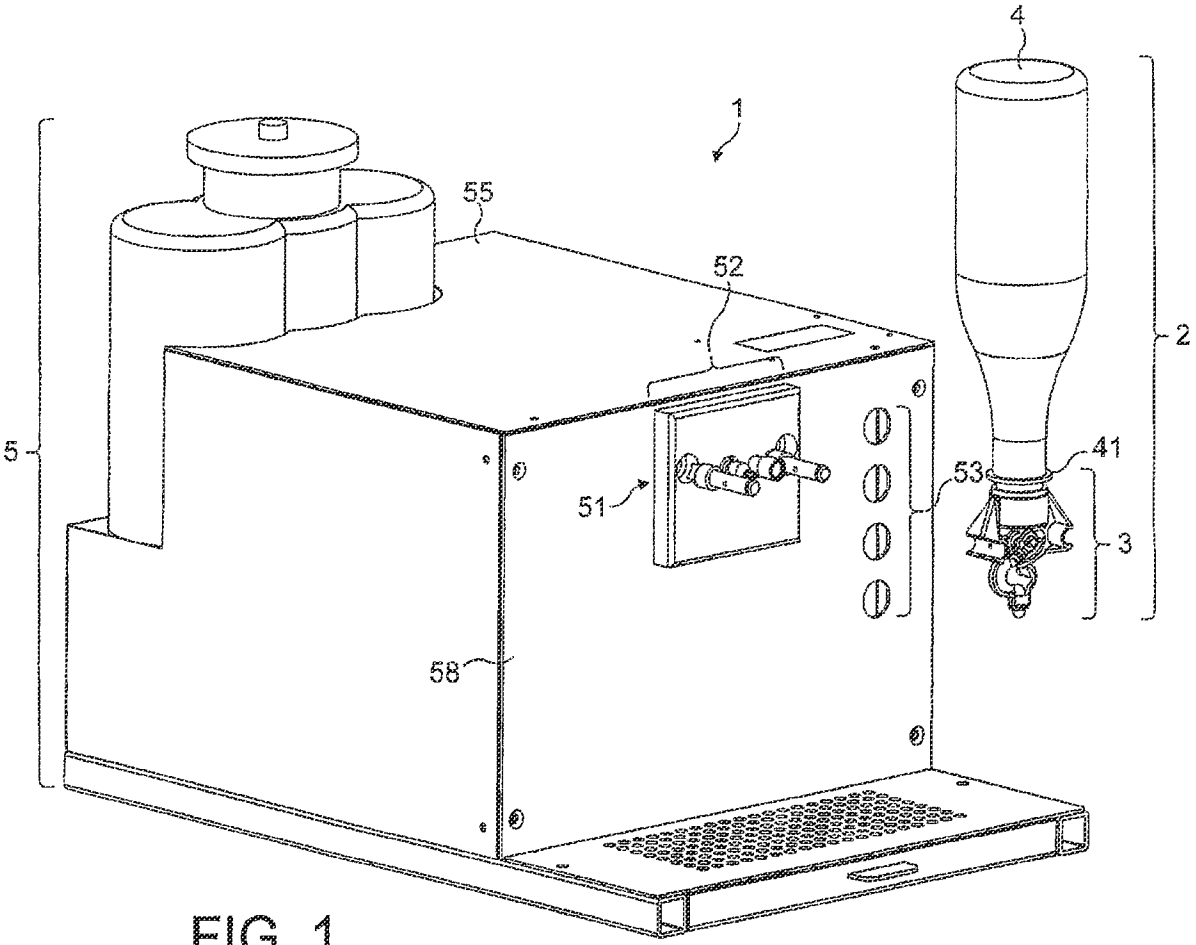
FIG. 1 depicts an overall perspective view of the preparation system according to the invention comprising a multi-portion package according to the invention in a position separate from the base station.
Figure 2:
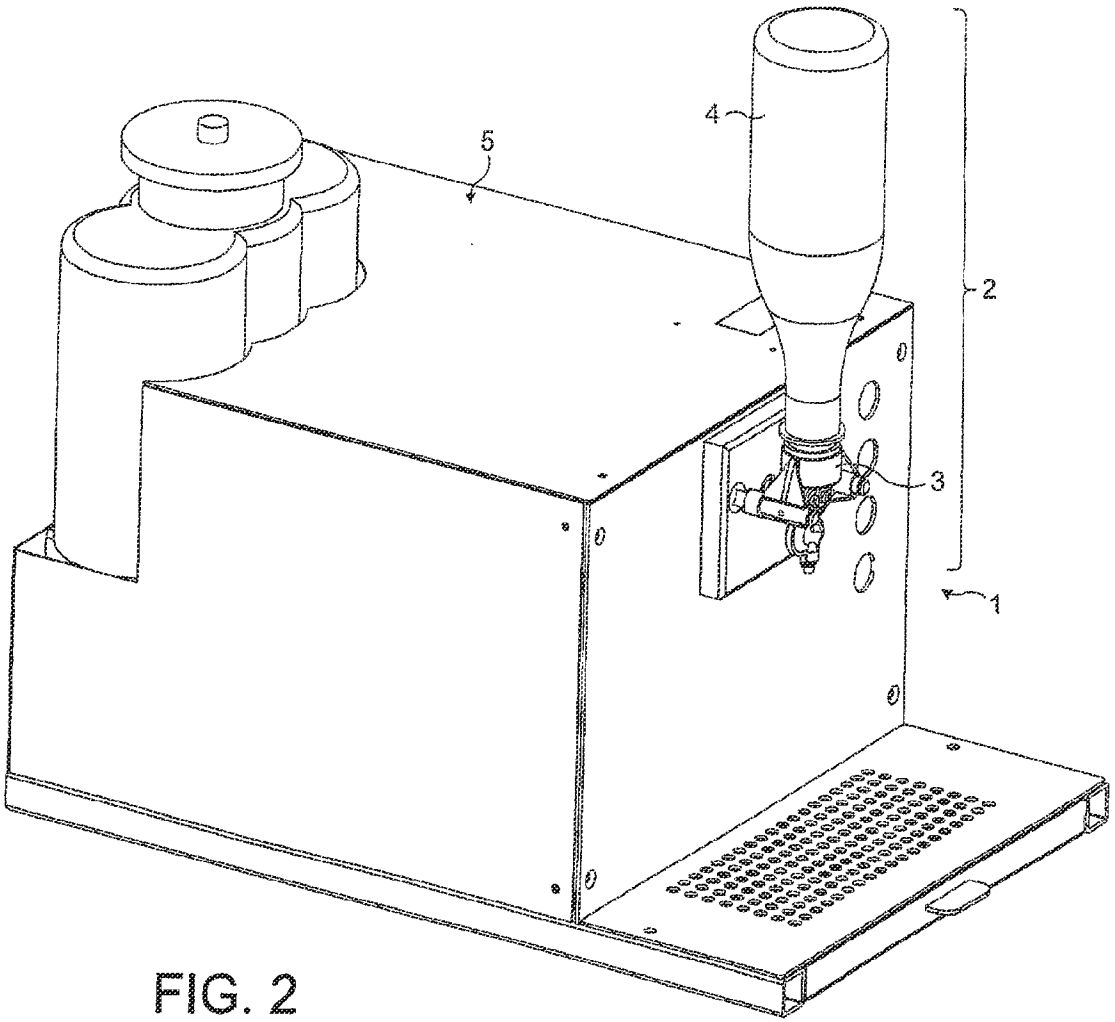
FIG. 2 depicts an overall perspective view of the system of FIG. 1 with the multi-portion package in a docked position against the base station.
Figure 3:
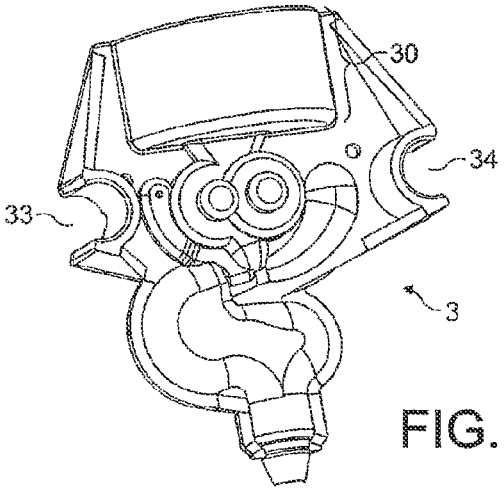
FIG. 3 depicts a view of the front half-shell of the metering and mixing device according to the invention.
Figure 4:
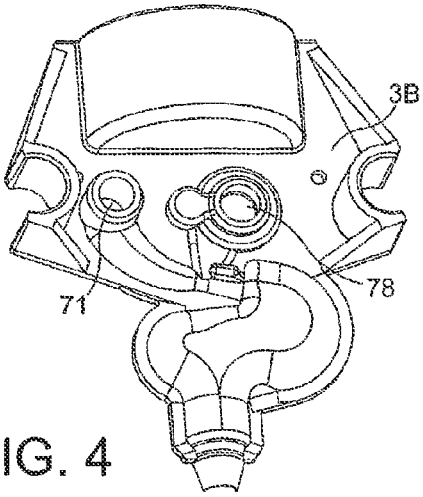
FIG. 4 depicts a view of the rear half-shell of the metering and mixing device according to the invention.
Figure 5:
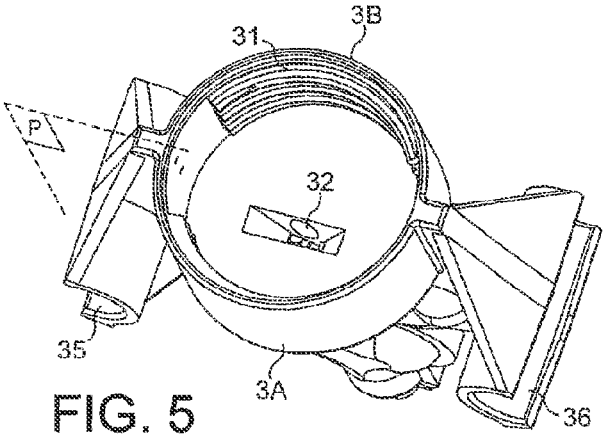
FIG. 5 depicts a view from above of the device of FIGS. 3 and 4.
Figure 6:
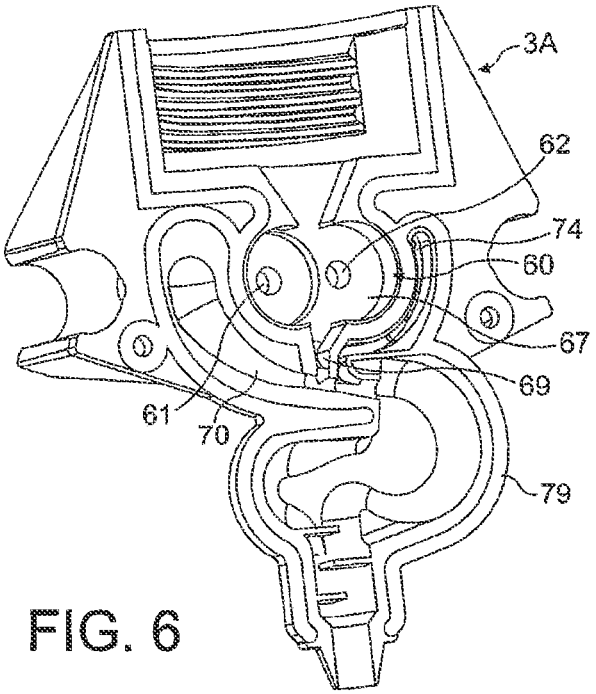
FIG. 6 depicts an internal view of the frontal half-shell of the device of FIGS. 3 to 5, without the gear elements.
Figure 7:
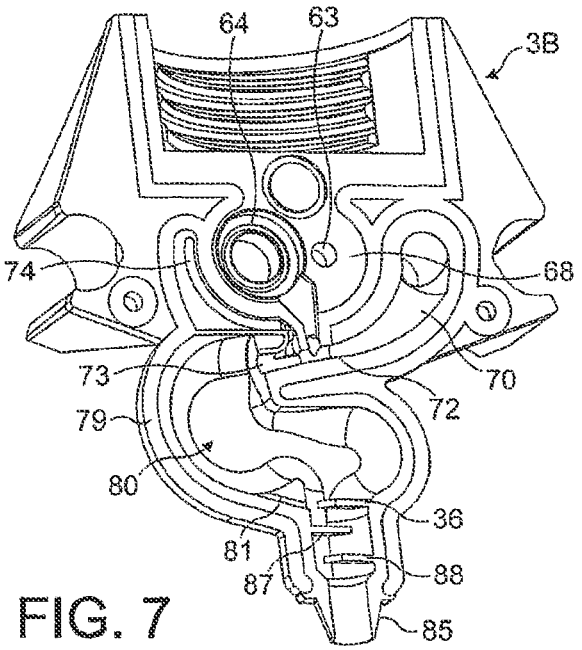
FIG. 7 depicts an internal view of the rear half-shell of the device of FIGS. 3 to 5.

FIGS. 1 and 2 illustrate an overall view of one example of a system for reconstituting and delivering food preparations according to the invention, in particular, of a system for preparing hot or cold drinks 1.

The system comprises, on the one hand, at least one functional package 2 formed of a metering and mixing device 3 and of a container 4 and, on the other hand, a base station 5 which serves to anchor the functional package 2 with a view to preparing and delivering the drinks through the metering and mixing device 3. The device 3 is connected to a container 4 which may be of any kind, such as a bottle, a brick, a sachet, a pouch or the like. The container contains a food liquid intended to be diluted with a diluent, generally hot, ambient-temperature or chilled, water, supplied to the metering device 3 via the base station 5. The liquid may be a concentrate of coffee, milk, cocoa, fruit juice or a mixture such as a preparation based on coffee concentrate, an emulsifier, flavourings, sugar or artificial sweetener, preservatives and other components. The liquid may comprise a purely liquid phase with, possibly, solid or pasty inclusions such as grains of sugar, nuts, fruit or the like. The liquid is preferably designed to be stable at ambient temperature for several days, several weeks or even several months. The water activity of the concentrate is thus usually set to a value that allows it to keep at ambient temperature for the desired length of time.

The metering and mixing device 3 and the container 4 are preferably designed to be disposed of or recycled once the container has been emptied of its contents. The container is held in an inverted position, its opening facing downwards and its bottom facing upwards, so as to constantly supply the metering and mixing device 3, particularly the liquid metering pump contained therein, with liquid under gravity. The container 4 and the device 3 are connected by connecting means which may be detachable or permanent as the case may be. It is, however, preferable to provide permanent-connection means in order to avoid excessively prolonged use of the metering and mixing device which, without cleaning after an excessively lengthy period of activity, could end up posing hygiene problems. A permanent connection therefore forces the replacement of the entire package 2 once the container has been emptied, or even before this if the device remains unused for too long and if a hygiene risk exists. However, the inside of the device 3 is also designed to be able to be cleaned and/or rinsed out with diluent, at high temperature for example regularly, for example during rinsing cycles that are programmed or manually activated and controlled from the base station 5.

FIGS. 3 to 9 show the metering and mixing device 3 of the invention in detail according to a preferred embodiment. The device 3 is preferably in the form of a cap which closes the opening of the container in a sealed manner when the container is in the inverted position with its opening facing downwards. The cap has a tubular connecting portion 30 equipped with connecting means such as an internal screw thread 31 complementing connecting means 41 belonging to the container, also of the screw thread type for example. Inside the connecting portion there is an end surface and an inlet 32 situated through this end surface, for liquid to enter the device. It should be noted that the inverted position of the container is justified only if the container has an air inlet for equalizing the pressures in the container and does not therefore contract as it empties. If the opposite is true, such as in the case of a bag which contracts without air, the liquid can be metered when the container is in a position which is not necessarily the inverted one with the cap.

The device 3 is preferably made up, amongst other things, of two half-shells 3A, 3B assembled with one another along a parting line P running more or less in the longitudinal direction of the ducts, particularly of the liquid duct and of the mixing chamber, circulating within the device. The construction in the form of two half-shells, namely a frontal part 3A and a rear other part 3B, makes it possible to simplify the device while at the same time defining the succession of ducts and chambers needed for metering, mixing, possibly frothing, and delivering the mixture.

When the container is one that cannot contract, it is necessary to provide an air inlet into the container in order to compensate for the withdrawal of the liquid. Such an inlet may be provided either through the container itself, such as an opening in the bottom of the container, once this container is in the inverted position, or alternatively at least one air channel through the tubular connecting portion 30 of the device which communicates with the inlet to the container.

Figure 8:
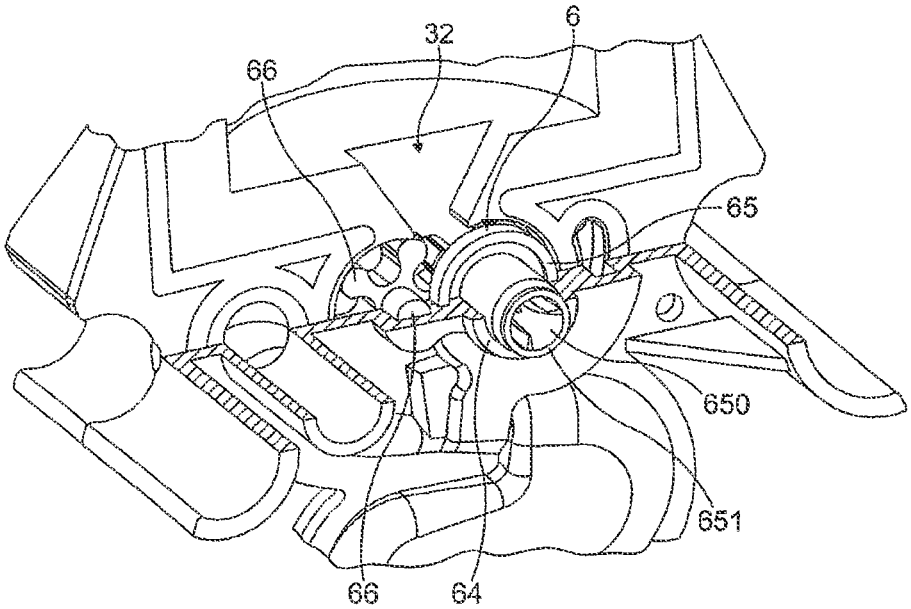
FIG. 8 depicts a detailed view in part section of the pump of the device of FIGS. 3 to 7.
Figure 10:
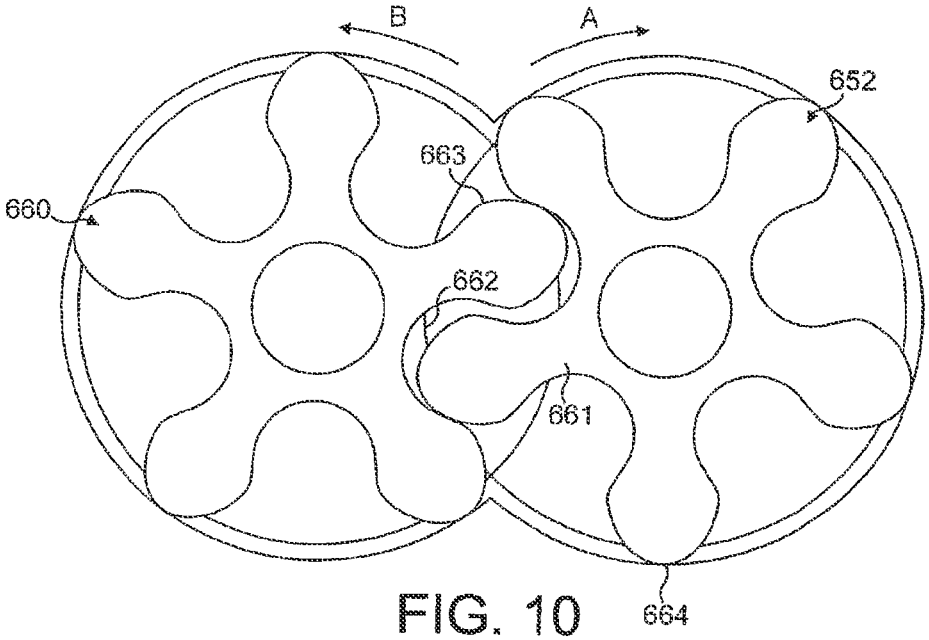
FIG. 10 depicts a schematic front view of the rotary elements in a given geared configuration.

The basic principle of the metering and mixing device 3 will now be described in detail. The device comprises a built-in metering pump 6 for metering the liquid passing through the opening 32. The pump is preferably a gear pump defined by a chamber 60 equipped with bearings 61, 62, 63, 64 present at the bottom of each lateral surface 67, 68 of the chamber and able to guide two rotary elements 65, 66 cooperating in a geared fashion in order to form the moving metering elements of the pump in the chamber. The rotary element 65 is a "master" element equipped with a shaft 650 associated with a coupling means 651 able to engage with a complementary coupling means belonging to the base station 5 (described later on). A lip seal is preferably incorporated between the bearing 64 and the shaft 650 to seal the pump chamber with respect to the outside. The internal pressure when the pump is in motion helps with maintaining sealing by stressing the seal. The rotary element 66 is the "slave" element which is driven in the opposite direction of rotation by the master element. The rotary metering elements 65, 66 are driven in directions A, B as illustrated in FIGS. 8 and 10 in order to be able to meter the liquid through the chamber. The construction in the form of half-shells is such that the chamber is defined by the assembly of the two parts 3A, 3B. The chamber 60 may thus be defined as a hollow in the frontal part 3A with a bottom surface 67 defining one of the lateral surfaces. The other part encloses the chamber via a more or less flat surface portion 68, for example, comprising the bearing 64 that supports the drive shaft 650, which is extended backwards through a passage 78 through the shell part 3B.

The liquid is thus metered through a liquid outlet duct 69 forming a reduction in section. The diameter is of the order of 0.2 to 4 mm, preferably 0.5 to 2 mm. The duct 69 allows fine control over the flow rate of liquid leaving the pump and makes it possible to form a relatively narrow flow of liquid, thus encouraging fine metering.

The device comprises a duct 70 for supplying with diluent which intersects the liquid duct 69. The diluent is conveyed into the device through a diluent intake 71 located through the rear part 3B of the cap. This intake has the form of a connecting tube able to be forcibly fitted with sealing into a tubular coupling and diluent-supply part located on the base station 5. The diluent flow rate is controlled by a diluent pump situated in the base station 5. The diluent duct 70 ends in a restriction 72 beginning more or less upstream of the point where the liquid and diluent ducts 69, 70 meet and extending at least as far as that point and preferably beyond the meeting point. The restriction makes it possible to accelerate the diluent and this, using a venturi phenomenon, causes a pressure at the meeting point that is lower than or equal to the pressure of the liquid in the liquid outlet duct 69. When the pump is switched off, this equilibrium or differential of pressures, ensures that the diluent crosses the metering point and travels as far as the chamber without rising back up inside the liquid duct. The liquid pump stops while the diluent continues to pass through the device, for example towards the end of the drink preparation cycle in order to obtain the desired dilution of drink. Likewise, the diluent is used to regularly rinse the device. Thus the liquid, for example a coffee or cocoa concentrate, is prevented from being contaminated in the container or the pump by diluent being sucked back through the duct 69.

The restriction is thus sized to create a slight depression at the meeting point. However, the depression needs to be controlled so that it does not excessively lower the boiling point and cause the diluent to boil in the duct when hot drinks are being prepared.

For preference, the restriction has a diameter of between 0.2 and 5 mm, more preferably between 0.5 and 2 mm.

After the meeting point, one and the same duct 73 transports the fluids. A widening of the duct is preferably designed to reduce the pressure drop and take account of the increase in volume of the fluids which combine once they have met at the meeting point. The widened duct 73 is extended into a mixing chamber 80 proper, in which the product is homogeneously mixed. Of course, the duct portion 73 and the chamber 80 could form one and the same duct or one and the same chamber without there necessarily being an abrupt change.

An air intake embodied by an air duct 73 open to the open air is preferably provided when frothing of the liquid-diluent mixture is desired. As a preference, the air duct may be positioned to intersect with the restriction. It is in this region that the venturi effect is felt and therefore that the reduction in pressure is at its maximum because of the acceleration of the fluids. The air duct may thus be positioned to intersect the duct portion 73 for example. The position of the air intake may vary and may also be sited in such a way as to lead to the diluent duct 70 or alternatively to the liquid duct 69. Thus, as a preference, the air intake is positioned such that the air is sucked in by the effect of the diluent accelerating through the restriction.

In a possible mode (not illustrated), an air pump can be connected to the air intake. The air pump can be used for creating a positive pressure in the air intake which can force air to mix with the diluent stream. Normally, the restriction of the diluent duct is enough to draw a sufficient amount of air to create bubbles in the mixture but an air pump could prove to be helpful, in particular, at elevated diluent temperatures, where steam may start forming in the device thus resulting in no sufficient air to be able to be drawn. The air pump may also be used to send air in the mixing chamber at the end of the dispensing cycle in order to empty the chamber of the mixture and/or to dry off the mixing chamber for hygiene purpose. The air intake should also be connected to atmospheric pressure at the end of the dispensing cycle to ensure that the mixing chamber can properly empty. Such atmospheric pressure balance can be obtained by an active valve placed at the higher point in the air feed system.

The mixing chamber 80 has a width of the order of at least five times, preferably at least ten or twenty times, the cross section of the duct portion 73 more or less at the exit from the meeting point. A broad chamber is preferable to a simple duct to encourage mixing and also to prevent any liquid from being sucked back into the venturi system when the device is at rest, as this could detract from the maintaining of good hygiene in the device. However, in principle, the chamber could be replaced by a duct of smaller cross section.

The chamber also allows the mixture to be decelerated and therefore avoids the mixture being expelled too abruptly and possibly causing splashing as it is delivered. For that, the chamber preferably has a bowed shape, or even preferably has the shape of an S so as to lengthen the path of the mixture and reduce the speed of the mixture.

The chamber is connected mainly to a delivery duct 85 for delivering the mixture. A siphon passage 81 may also be provided in order to completely empty the chamber because of its bowed shape, after each delivered drink cycle.

The duct preferably comprises elements 86, 87, 88 for breaking down the kinetic energy of the mixture in the duct. These elements may, for example, be several walls extending transversely to the duct and partially intersecting the flow of mixture and forcing this mixture to follow a sinuous path. These elements may also have a function of homogenizing the mixture before it is let out. Of course, other forms are possible for breaking the flow of the drink.

The metering and mixing device according to the invention also preferably comprises guide means allowing docking with the base station and, in particular, facilitating alignment of the diluent coupling and pump drive means. These guide means may, for example, be portions of surfaces 33, 34, 35, 36 through the device, for example, transversely to the parts 3A, 3B. The surfaces may, for example, be partially or completely cylindrical portions. The guide means also perform the function of supporting the weight of the package and ensure firm and stable docking. These means may of course adopt other highly varied shapes.

The parts 3A, 3B are assembled by any appropriate means such as welding, bonding or the like. In a preferred embodiment, the two parts are laser welded. The laser welding may be computer controlled and has the advantage of welding the parts together without any movement, unlike vibration welding; this improves the compliance with dimensional tolerances and the precision of the welding. For laser welding, one of the parts may be formed in a material that is more absorbent of laser energy while the other part is made of a plastic transparent to laser energy. However, other welding techniques are possible without departing from the scope of the invention, for example vibration welding.

It is preferable to provide a connecting joint 79, such as a weld, which partially or completely borders the ducts and chambers of the device. The joint is preferably perfectly sealed. However, a joint with non-welded regions may be provided in order to control the entry of air into the device.

Figure 9:
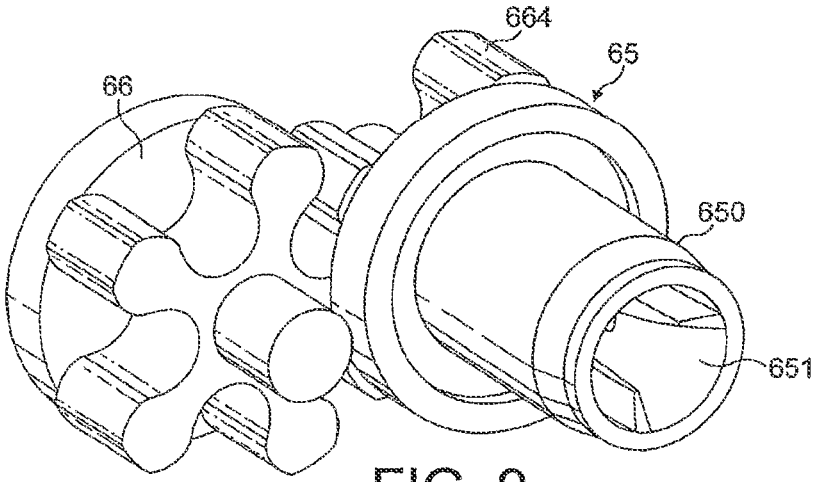
FIG. 9 depicts a perspective part view of the rotary elements of the liquid metering pump.

FIGS. 9 and 10 show a detailed depiction of the rotary elements 65, 66 of the liquid pump. In an advantageous construction, the gearing elements each have teeth 652, 660 of complementing shapes, the cross section of which has a rounded shape towards the ends with an area of restricted cross section 661 at the base of each of the teeth. Such a rounded tooth geometry makes it possible to create a closed volumetric metering region 662 which does not experience compression and transports a volume of liquid that is constant for each revolution. This configuration has the effect of reducing the effects of compression on the metered liquid and this improves the efficiency of the pump and reduces the loads on the pump. As a further preference, the outermost portion 662 of each tooth is flattened with a radius greater than the radius of the sides 663 of each tooth. In particular, the flattening of the most extreme portions 664 allows the teeth to be brought closer to the surface of the pumping chamber, thus reducing clearance and improving sealing.

The device may comprise several liquid pumps each comprising a liquid duct which meets the diluent duct. The advantage is then that of being able to mix several different liquids with flow rate ratios determined by each of the pumps. The pumps may be organized either in the same plane or in a parallel plane. The container may comprise several chambers containing different liquids, each chamber communicating with its corresponding pump. Thus, the preparation of a drink may comprise two components which have to be kept separate for reasons of stability, shelf life, or preferably, for example, a base of concentrate on the one hand and a flavouring on the other, thus metered by different pumps to reconstitute a flavoured drink or a drink with a better flavour. It is also possible to provide a separate diluent duct for each liquid duct.

It should be noted that the device can meter liquids over a wide range of viscosities. However, when the liquid is too fluid it may be necessary to add a valve to the liquid metering duct 69, or to the inlet 32, to prevent the risks of liquid leaks. The valve is configured to open under the thrust of the liquid exerted by the pump and to remain closed and sealed when the pump is switched off so as to prevent any liquid from leaking through the device.

It should also be noted that the container, if not specifically designed to be collapsible, may require to be returned to a pressure of equilibrium with the external environment by the way of a venting means. If the container is not vented, it may collapse due to pressure reduction inside it and it can break. A venting means may be a valve such a duckbill valve and the like. Another way of venting the container may be to drive the pump for several turns in the direction opposite to the metering direction.

Figure 11:
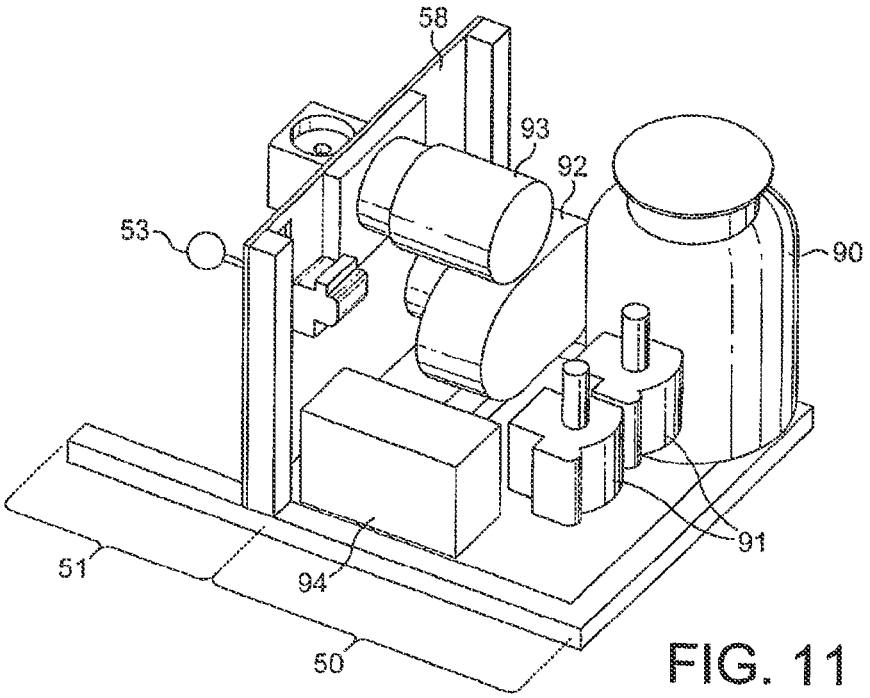
FIG. 11 depicts a schematic view of the inside of the base station.

With reference to FIGS. 1-2, 11 and 12 the system according to the invention also comprises a base station 5 forming the machine part, as opposed to the package 2. The base station comprises a technical area 50, generally internal and protected, at least in part, by a cover 55 and an interface area 51 directly accessible to the user. The interface area also offers control means 53 for controlling the delivery of a drink. The control means may be in the form of an electronic control panel (FIGS. 1 and 2) or a lever (FIG. 11)

Figure 12:
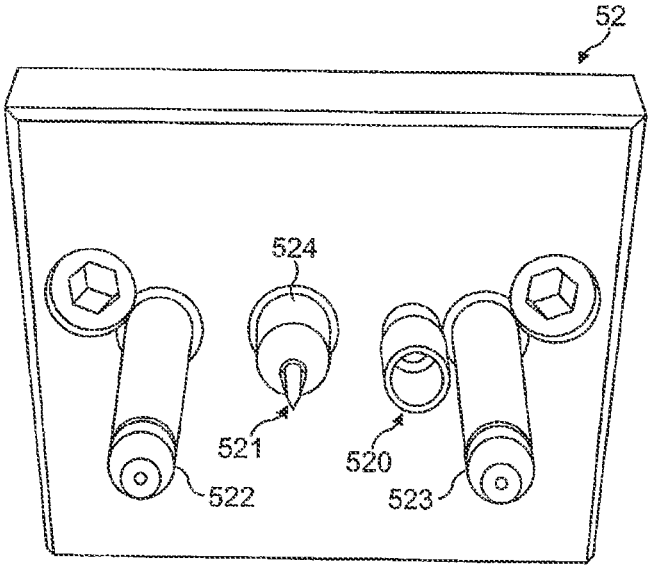
FIG. 12 depicts a detailed view of the base station coupling means.

The interface area 51 is configured to allow the docking of at least one package 2, via at least one docking station 52. Several docking stations may be provided, arranged in rows to each accept a package containing a different or the same food liquid, so that a varied choice of drink can be offered or alternatively in order to increase the system's serving capacity. As FIG. 12 shows in detail, a docking station comprises a diluent coupling means 520 and a means for coupling the drive to the metering pump 521. The means 520 may be a portion of a tube fitted with a non-return valve the diameter of which complements the diameter of the diluent intake 71 of the metering and mixing device so as to engage therewith. Assembly may be achieved using one or more seals. The coupling means 521 is, for example, a portion of a shaft ending in a head of smaller cross section and with surfaces that complement the internal surfaces of the coupling means 651 belonging to the metering and mixing device. The head may have a pointed shape of polygonal cross section or may be star shaped, for example, offering both speed of engagement and reliability in the rotational drive of the pump. The docking station may also comprise guide means 522, 523 that complement the guide means 33, 34 of the metering and mixing device. These means 522, 523 may be simple bars or fingers to accept the surfaces of the guide means in sliding. It goes without saying that the shape of the guide means 522, 523, 33, 34 may adopt numerous forms without departing from the scope of the invention. Thus, the guide means 522, 523 of the docking station may be hollow shapes and the guide means 33, 34 may be raised.

The base station, as illustrated in FIG. 11, has a technical area 50 which combines the essential components for supplying the metering and mixing device 3 with diluent and for driving the liquid pump. For that, the base station comprises a diluent supply source, such as a reservoir of drinking water 90 connected to a water pumping system 91. The water is then transported along pipes (not featured) as far as a water temperature control system 92. Such a system may be a heating system and/or a refrigeration system allowing the water to be raised or lowered to the desired temperature before it is introduced into the metering and mixing device 3. Furthermore, the base station possesses an electric motor 93 controlled by a controller 94. The electric motor 93 comprises a drive shaft 524 which passes through the docking panel 58.

As a preference, the system according to the invention offers the possibility of varying the metering of the liquid according to the requirements via a control panel 53 featured in the interface area, thanks to a selection of buttons each of which selects a specific drinks dispensing program. In particular, the liquid:diluent dilution ratio can vary by varying the speed at which the pump is driven. When the speed is slower, the diluent flow rate for its part being kept constant by the diluent pump system 91, the liquid:diluent ratio is thus reduced, leading to the delivering of a more dilute drink. Conversely, if the liquid pump speed is higher, the concentration of the drink can be increased. Another controllable parameter may be the volume of the drink by controlling the length of time for which the diluent pump system is activated and the length of time for which the liquid pump is driven. The controller 94 thus contains all the necessary drinks programs corresponding to the choice effected via each button on the control panel 53.

The metering and mixing device or the container may also comprise a code that can be read by a reader associated with the base station 5. The code comprises information referring to the identity and/or the nature of the product and/or to parameters concerned with the activating of the diluent supply and/or liquid pump drive means. The code may, for example, be used to manage the flow rate of the liquid pump and/or of the diluent pump, contained in the base station, so as to control the liquid:diluent ratio. The code may also control the opening or closing of the air intake in order to obtain a frothy or non-frothy drink.

Figure 13:
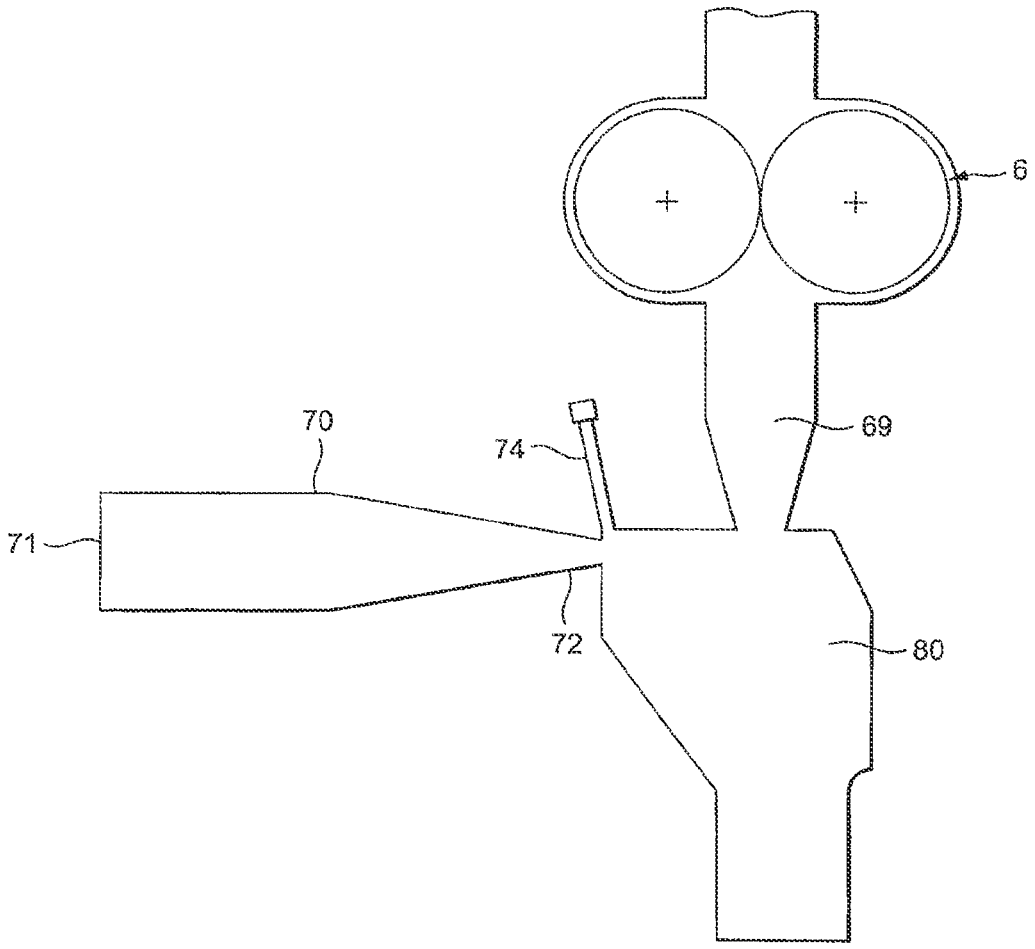
FIG. 13 depicts a schematic view of the device of the invention according to a different fluidic arrangement.

As illustrated in FIG. 13, the air intake or channel 74 can be placed to intersect the diluent duct 70. Therefore, it is placed before the intersection of the liquid stream and diluent stream. The problem with air channel placed after the intersection of the liquid and diluent ducts is that the air channel can become contaminated by diluted liquid which may cause bacterial growth. The problem is mostly caused by geometry and physical factors such as liquid surface tension, phase changes, etc. This air channel cannot be properly cleaned during a flushing cycle with a cleaning liquid (i.e., hot water) as the restriction causes a suction effect from the air channel to the mixing chamber that prevents the cleaning liquid from entering the air channel. Therefore, this new location ensures that no food liquid can enter the air channel. In the present example, the diluent duct 70 and the liquid metering duct 69 are not directly positioned in intersection one another but meet with the mixing chamber 80. The diluent duct 70 is nevertheless positioned in such a way that its stream is directed toward the liquid stream, i.e., in the direction of the liquid outlet or slightly below. An air intake 74 is furthermore provided in the region of the restriction 72. The diluent speed is such in that region that air is sucked in the diluent stream before the stream meets the liquid stream. Such an arrangement reduces the risk of the air intake being contaminated with the diluted product coming in the air intake by accident.

Figure 14:
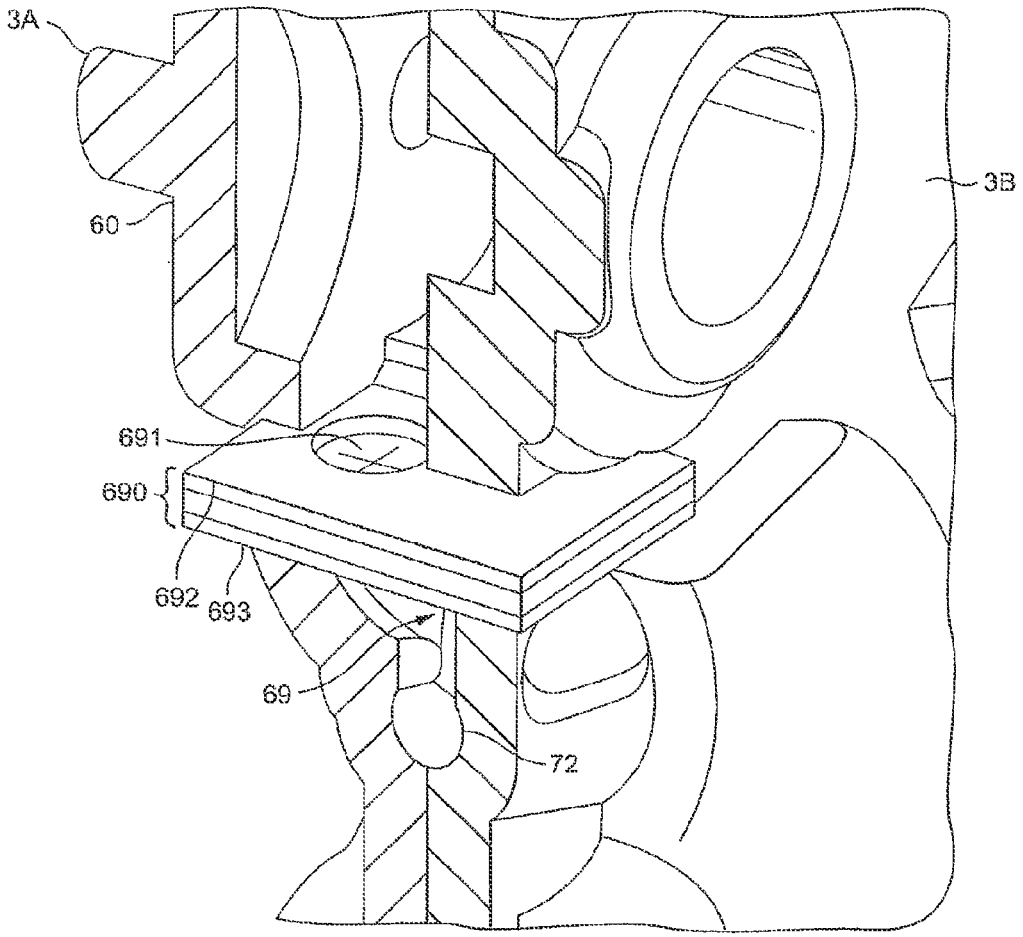
FIG. 14 depicts a detail cross sectional view of an embodiment of the device of the invention, in particular, a non-return valve that is positioned at the pump outlet to prevent liquid dripping.

In an embodiment illustrated by FIG. 14, the device comprises a non-return valve for the metered liquid. Indeed, since it is virtually impossible to guarantee total tightness in particular for low viscosity liquids, a valve 690 is added in the liquid metering conduit downstream of the pump. Since traces of water cannot be removed in the intersection area 72 and the mixing chamber, if liquid drips from the pump to these areas, the diluent could contaminate the liquid therefore causing a potentially favourable ground for bacterial growth after several hours of inactivity. The valve prevents this issue by stopping the liquid from dripping during inactivity of the device. The valve can be any sort of non-return valve. In FIG. 14, the valve comprises an elastomeric or silicone slit valve member or layer 691 maintained transversally in the liquid duct 69 by two rigid plies such as two metal plates 692, 693. The valve 690 can be inserted through slots provided through the two half-shells 3A, 3B. The slit valve member is configured so that the slits open downwardly when a fluid pressure has built up upstream the valve as a result of the pump being activated in the pump chamber 60 (pump members not shown). As soon as the pump is stopped, the valve is resilient enough to close off the outlet.

The invention also extends to the field of the preparation of non-food products. For example, the invention may be used in the field of the dispensing of products which come in the form of liquids that can be diluted, such as washing powders, soaps, detergents or other similar products.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A package for metering a liquid and mixing this liquid with a diluent to prepare a product, comprising:

a multi-dose container to form a reserve of liquid;

a metering and mixing device comprising:

a diluent inlet, a liquid pump for metering the quantity of liquid, a mixing chamber for mixing the liquid and the diluent, a diluent coupling member and a member for driving the liquid pump which are configured to connect the metering and mixing device to a base station capable of providing a diluent supply to the diluent coupling member and capable of driving the member for driving the liquid pump, wherein the metering and mixing device comprises two half-shells assembled with one another along a parting line and configured to delimit at least the contours of a chamber of the pump and the mixing chamber.

2. The package of claim 1, wherein the two half-shells define, by their assembly, along their parting line, a liquid metering duct of the metering device for delivering the flow of diluted and mixed liquid directly to a receptacle, the liquid metering duct thus extending the mixing chamber.

3. The package of claim 2, comprising a diluent duct that intersects the liquid metering duct, wherein the two half-shells define, along the parting line, the liquid metering duct and, at least partially, the diluent duct.

4. The package of claim 2, wherein the diluent duct is positioned relatively to the liquid metering duct so that a stream of the diluent intersects a stream of the liquid before or at the mixing chamber.

5. The package of claim 4, wherein the metering and mixing device comprises a means for increasing the speed at which the diluent arrives at a point where the streams meet, in the form of a restriction in communication with a diluent intake situated upstream of the mixing chamber so that the flow of diluent is accelerated through the restriction.

6. The package of claim 1, wherein the metering and mixing device comprises an air intake before or in the mixing chamber to carry air into the mixture of the diluent and the liquid and cause the mixture to froth.

7. The package of claim 1, wherein the liquid is selected from the group consisting of a food concentrate intended to be reconstituted, a hot drink, a cold drink, a frothy drink and a non-frothy drink.

8. The package of claim 1, wherein the liquid is a soap, detergent or other similar product for the preparation of a non-food product.

9. A container cap for metering a base liquid and mixing the base liquid with a diluent to prepare a food product, the container cap being so constructed and arranged to be connected to a container containing the base liquid, and the container cap comprising:

a diluent inlet, a liquid pump for metering the quantity of liquid, a mixing chamber for mixing the liquid and the diluent, a diluent intake and a coupling member for driving the liquid pump which are configured to connect the container cap to a base station capable of providing a diluent supply to the diluent intake and capable of driving the coupling member for driving the liquid pump, and two half-shells assembled with one another along a parting line and configured to delimit at least the contours of a chamber of the liquid pump and the mixing chamber.

10. The container cap of claim 9, with the diluent intake being complementary to a diluent coupling member of the base station and the coupling member for driving the liquid pump being complementary to a member for coupling the liquid pump of the base station, the coupling member for driving the liquid pump being arranged to receive a drive shaft attached to the base station.

11. A package for docking to a base station and for metering a liquid and mixing this liquid with a diluent to prepare a product, the package comprising:

a multi-dose container to form a reserve of liquid;

a metering and mixing device comprising:

a diluent inlet, a liquid pump for metering the quantity of liquid, a mixing chamber for mixing the liquid and the diluent, a plurality of coupling members each complementing a coupling member of the base station, the coupling members of the package comprising a diluent intake and a coupling member for driving the liquid pump, the diluent intake being complementary to a diluent coupling member of the base station and the coupling member for driving the liquid pump being complementary to a member for coupling the liquid pump of the base station, the coupling member for driving the liquid pump being arranged to receive a drive shaft attached to the base station, wherein the metering and mixing device comprises two half-shells assembled with one another along a parting line and configured to delimit at least the contours of a chamber of the pump and the mixing chamber.

* * * * *